United States Patent [19]

Sickles

[11] 4,240,585

[45] Dec. 23, 1980

[54] ELECTROSTATIC SPRAYING APPARATUS WITH REPELLING ELECTRODE MEANS AND GAS SHROUD

[75] Inventor: James E. Sickles, Glenshaw, Pa.

[73] Assignee: PPG Industries, Inc., Pittsburgh, Pa.

[21] Appl. No.: 42,184

[22] Filed: May 24, 1979

[51] Int. Cl.[3] ..... B05B 5/02

[52] U.S. Cl. ..... 239/705; 239/291

[58] Field of Search ..... 239/3, 290-301, 239/690, 691, 706, 705, 708; 427/13, 25-27, 30; 118/620, 621, 624, 627, 640

[56] References Cited

U.S. PATENT DOCUMENTS

| | | | |
|---|---|---|---|
| 3,700,168 | 10/1972 | Ferrant | 239/3 |
| 4,106,697 | 8/1978 | Sickles et al. | 239/705 |

*Primary Examiner*—Robert B. Reeves
*Assistant Examiner*—Gene A. Church
*Attorney, Agent, or Firm*—George D. Morris

[57] ABSTRACT

Electrostatic spraying apparatus comprising a housing having an opening, liquid atomization means and induction charging electrode means mounted in said housing to deliver an electrically charged spray of liquid particles outwardly through the opening, inlet means to said housing for delivering to the housing a flow of gas for subsequent envelopment of the electrically charged spray of liquid particles upon exit from the housing, and repelling electrode means of a polarity the same as the electrically charged spray and defining an electrical repulsion zone for repelling said spray immediately prior to and after the exiting of said spray from the opening. Relatedly disclosed are an electrostatic induction charging gas shroud adapter and a repelling electrode adapter, each to be employed with appropriate atomization means to deliver an electrically charged spray of liquid particles as described above.

20 Claims, 6 Drawing Figures

ELECTROSTATIC SPRAYING APPARATUS WITH REPELLING ELECTRODE MEANS AND GAS SHROUD

BACKGROUND OF THE INVENTION

Utilization of spraying apparatus in the application of a coating material such as a paint composition or other liquid is well recognized in the art as an efficient way to provide uniform deposition of the coating material on a workpiece. Various types of spraying apparatus have been devised to accomplish this deposition, and include conventional spray guns, spray guns having electrostatic charging means, and spray guns provided with gas shroud means along with electrostatic charging means whereby gas concentrically envelops an electrically charged spray stream as the stream travels from the spray gun to a workpiece to be coated. An example of spraying apparatus which embodies electrostatic charging means and gas shroud means is found in U.S. Pat. No. 4,106,697 to Sickles et al.

When a gas-shrouded induction charging spray apparatus is employed, an electrically charged spray of liquid particles travels to the workpiece and is atmosphere-protected from the ambient atmosphere by the gas enveloping the spray, thereby permitting controlled humidity, temperature, and appropriately-conditioned gaseous requirements. However, because the liquid particles comprising the spray are charged, they have a tendency to drift to any site of lower electrical potential, including the housing itself which provides origination of the gas shroud envelope. As a result, prolonged periods of spraying can result in coating material buildup on this housing. Further, because substantially all of the charged liquid particles of the spray have the same polarity, they repel each other and can therefore broaden the spray stream beyond a desired configuration.

It is therefore an object of this invention to enhance the axial integrity of the spray stream upon its exiting from the spraying apparatus in travel toward a workpiece to be coated. It is a further object of the invention to inhibit deposition of charged sprayed liquid particles on the spraying apparatus and its fixtures, and to simultaneously, via a repulsion effect, drive charged particles toward the workpiece and thereby improve coating deposition efficiency. These and other objects will be apparent throughout the body of this application.

SUMMARY OF THE INVENTION

The subject of the invention described and claimed herein is an electrostatic spraying apparatus comprising:

(a) an electrically non-conductive or dielectric housing having an opening with a perimeter;

(b) liquid atomization means mounted in said housing, said liquid atomization means being capable of dispersing a liquid into a spray of liquid particles directed outwardly through the opening of the housing;

(c) a screen extending essentially radially outwardly from the liquid atomization means and disposed substantially entirely between the liquid atomization means and the perimeter of the opening, the screen adjacent the liquid atomization means providing induction charging electrode means and the remainder of the screen being dielectric or electrically non-conductive, the induction charging electrode means being chargeable to a first polarity and being in cooperative spatial relationship with the liquid atomization means to impart an electrical charge on said liquid particles substantially simultaneously with the formation of said liquid particles to produce an electrically charged spray of liquid particles, said imparted electrical charge being of a second polarity which is opposite the polarity of the induction charging electrode means;

(d) gas inlet means to the housing for delivering a flow of gas to said housing whereby said gas exits through the opening of the housing and substantially concentrically envelops the electrically charged spray of liquid particles; and (e) repelling electrode means mounted within the housing and spaced inwardly from the perimeter of the opening said repelling electrode means being substantially electrically isolated from the induction charging electrode means and being chargeable to a polarity opposite the polarity of the induction charging electrode means and of the same polarity as the electrically charged spray of liquid particles to repel said spray of liquid particles immediately prior to the exiting of said spary of liquid particle from the opening of the housing.

Additionally described and claimed are (1) an electrostatic induction charging gas shroud adapter within which liquid atomization means such as a spray gun be mounted; and (2) a repelling electrode adapter mountable to liquid atomization induction charging means. The gas shroud adapter comprises:

(a) an electrically non-conductive or dielectric housing to which can be mounted liquid atomization means and having an opening with a perimeter, said liquid atomization means when mounted being capable of dispersing a liquid into a spray of liquid particles directed outwardly through said opening;

(b) a screen extending essentially radially outwardly from the liquid atomization means when mounted and disposed substantially entirely between the liquid atomization means when mounted and the perimeter of the opening, the screen adjacent the liquid atomization means when mounted providing induction charging electrode means and the remainder of the screen being dielectric or electrically non-conductive, the induction charging electrode means being chargeable to a first polarity and being in cooperative spatial relationship with the liquid atomization means when mounted to impart an electrical charge on sprayed liquid particles substantially simultaneously with the formation of said liquid particles to produce an electrically charged spray of liquid particles, said imparted electrical charge being of a second polarity which is opposite the polarity of the induction charging electrode means;

(c) gas inlet means to the housing for delivering a flow of gas to said housing whereby said gas exits through the opening of the housing and substantially concentrically envelops the electrically charged spray of liquid particles issuing therefrom; and (d) repelling electrode means mounted within the housing and spaced inwardly from the perimeter of the opening, the repelling electrode means being substantially electrically isolated from the induction charging electrode means and being chargeable to a polarity opposite the polarity of the induction charging electrode means and of the same electrical polarity as the inductively charged spray of liquid particles to repel said spray of liquid particles immediately prior to the exiting of said spray from the opening.

The repelling electrode adapter for induction charging electrostatic spraying apparatus having induction charging electrode means chargeable to a first polarity comprises (a) an electrically non-conductive or dielectric housing mountable to an induction charging electrostatic liquid atomization means, the housing having an opening with a perimeter; and (b) semi-conductive repelling electrode means disposed in the housing and spaced inwardly from the perimeter of the opening, the semi-conductive repelling electrode means being substantially electrically isolated from the induction charging electrode means when mounted and being chargeable to a polarity opposite the polarity of the induction charging electrode means to define when mounted an electrical repulsion zone for repelling an inductively charged spray of liquid particles issuing from the induction charging electrostatic spraying apparatus.

The various devices above described can be used to apply a wide variety of liquid materials under widely diverse conditions of ambient humidity and temperature, since the envelope of gas which travels with the spray can be controlled and thereby create favorable atmospheric conditions during spray travel. Depending on the requirements of the material being sprayed, the choice of gas employed can be varied. Thus, for example, if air cannot be utilized because the spray material is oxygen sensitive, nitrogen or another inert gas can be used.

Induction charging electrode means as above described impart an electrical charge to the liquid particles comprising the spray stream, said charge being of a polarity opposite the polarity of the induction charging electrode means. When deposition of charged particles on an electrically receptive (e.g., grounded) workpiece occurs, transfer efficiency is increased because of the electrostatic attraction between the particles and the workpiece. A well-defined spray stream enhances this transfer efficiency since fewer charged liquid particles have drifted from said stream, thus providing maximum target deposition. To achieve such a spray stream, repelling electrode means, substantially electrically isolated from the induction charging electrode means and having the same polarity as the charged liquid particles, are disposed to define an electrical repulsion zone wherein the charged particles are repelled by said repelling electrode means and thereby forced to remain in a defined spray stream immediately prior to exiting the housing. Said particles are further repelled by the repulsion zone after exit and during travel to a workpiece to substantially prevent charged particles from returning to the housing, thus enhancing cleanliness of operation. The term "repulsion zone," as used herein, is defined as an area of region wherein particles, by virtue of their charge and polarity, are electrostatically deflected due to the presence of the repelling electrode means.

While the invention is described and exemplified in more detail in the following description and the accompanying drawings, it is to be understood that changes may be made in the specific embodiments disclosed without departing from the essentials of the invention set forth in the appended claims.

DETAILED DESCRIPTION OF PREFERRED EMBODIMENTS

Figure 1:
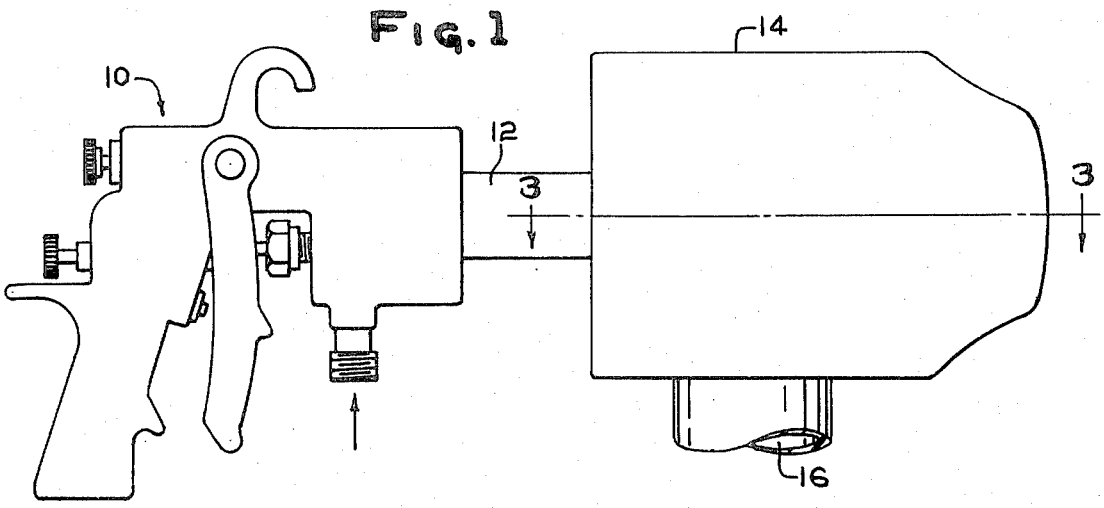
FIG. 1 is a side elevation view of an electrostatic spraying apparatus comprising a spray gun with a gas shroud housing having an induction charging electrode and a repelling electrode therein.

FIG. 1 shows as liquid atomization means a conventional hand-held, air-operated spray gun 10 having attached thereto a nozzle extender 12, as known in the art, extending into a gas shroud housing 14. The housing 14 has a gas inlet tube 16 to which a hose (not shown) can be connected for delivery of a gas under pressure from a gas source (not shown). While the inlet tube 16 is shown as entering perpendicularly to the wall of the housing 14, it is to be understood that said entry can be at an angle other than 90° to thereby provide a different air-flow pattern. The gas can be air or any other desired gas, and can be conditioned as to composition, temperature, humidity, pressure and the like as known in the art. The housing 14 is electrically non-conductive or dielectric, here constructed of fiberglass impregnated with epoxy resin. Outside diameter of the housing 14 in the embodiment illustrated is $4\frac{1}{4}$ inches (10.8 cm).

Figure 2:
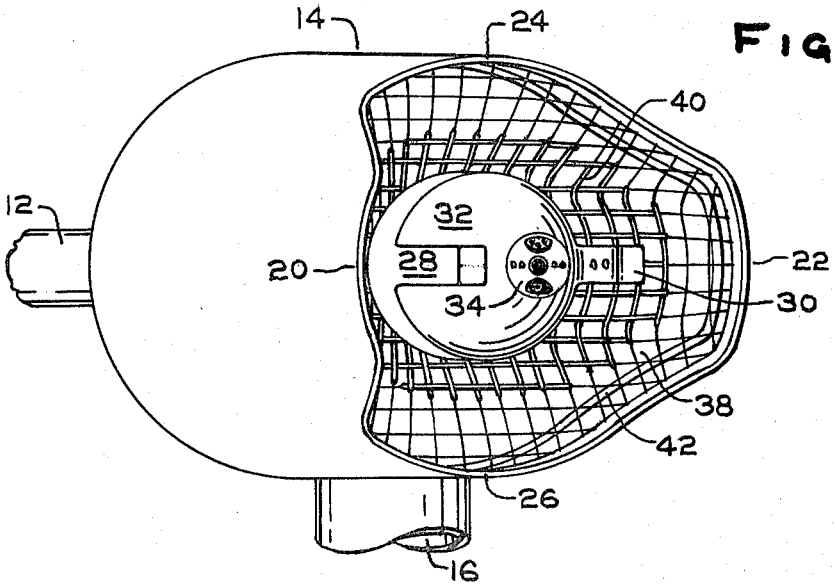
FIG. 2 is a perspective view of the gas shroud housing and spray gun nozzle assembly of FIG. 1.
Figure 3:
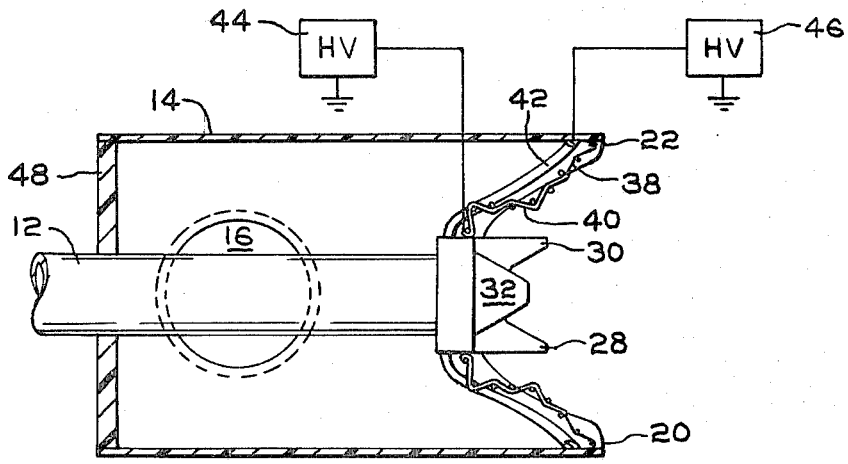
FIG. 3 is a top sectional view along line 3—3 of FIG. 1.
Figure 4:
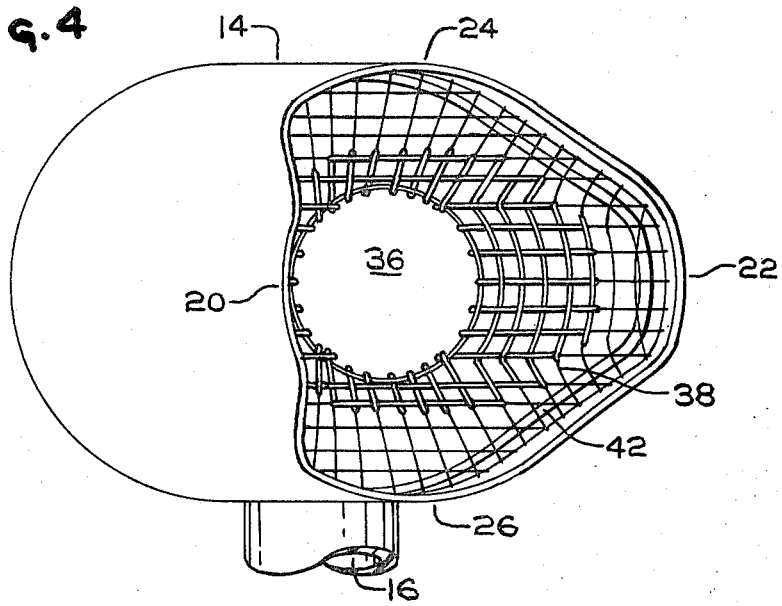
FIG. 4 is a perspective view of an electrostatic induction charging gas shroud adapter alone.

Referring to FIGS. 2, 3, and 4, the housing 14 is formed to provide two diametrically opposed lobes 20, 22 and two diametrically opposed recesses 24,26. Positioning of the lobes 20,22 corresponds directly with fan forming ears 28,30 of a spray gun air cap 32 comprising part of the nozzle assembly 34 which is mounted on the end of the nozzle extender 12. In this manner a fan-shape spray can be attained without interference from the housing 14. It is to be understood, however, that the recesses 24,26 are not necessary where a fan-shape spray is not required.

As shown in FIG. 4, a circular opening 36 in the housing 14 accepts the air cap 32 and nozzle assembly 34 as shown. Said air cap 32 is constructed of electrically non-conductive or dielectric material, here being an acetal resin. The fluid nozzle can be constructed of a conductive material such as a conductive plastic or metal and is electrically grounded through the coating composition being sprayed. Extending from the circular opening 36 to the perimeter of the housing 14 is a screen 38 upon a portion of which is coated an induction charging electrode 40 encircling the opening 36. The screen 38 is constructed of an electrically non-conductive or dielectric material such as nylon, with the induction charging electrode 40, having semiconductor properties, coated thereon. A repelling electrode 42 is coated along the circumference of the inner wall of the housing 14 near the perimeter of said housing. The perimeter of the screen 38 is secured to the perimeter of the housing 14 with a non-conductive adhesive. In the preferred embodiment both the induction charging electrode 40 and the repelling electrode 42 are constructed of a polyurethane resin-graphite matrix film coating. An induction-charging voltage source 44, shown diagrammatically, provides energy to the induction charging electrode 40, while a repelling-electrode voltage source 46, shown diagrammatically, provides energy to the repelling electrode 42. Because the repelling electrode 42 is disposed aft of the perimeter of the housing 14 and behind the screen 38, operator safety is improved since possible operator contact with the repelling electrode 42 is significantly inhibited.

As stated above, a portion of the screen 38 has coated thereon the induction charging electrode 40. It is to be understood, however, that the resulting induction charging portion of the screen need not necessarily be a coating. Thus, for example, a screen can be employed wherein a portion of the screen material itself encircling the opening 36 has semi-conductive properties, while the remaining portion of said screen material has electrically non-conductive or dielectric properties.

Regarding the polyurethane resin-graphite matrix film coating above, disclosed in copending patent application Ser. No. 911,645, filed June 1, 1978, a polyester-polyurethane clear coating formulation having a graphite conductive component is prepared in a two-package sprayable system. The resin-graphite matrix provides a resistance path which retards transport of electrical charge across the electrode surface to electrode edges or surface discontinuities which are susceptible to arcing or sparking to an electrical ground point. This resulting arc and spark repression reduces fire hazards should operation of the apparatus occur in a flammable environment. One package of the system comprises a polyester-polyol derived from components in the following proportions:

| | Parts by Weight |
|---|---|
| hexahydrophthalic acid anhydride | 173 |
| adipic acid | 138 |
| neopentyl glycol | 136 |
| trimethylolpropane | 122 |
| diethanolamine | 10 |
| n-butyl acetate | 177 |
| toluene | 44 |

To a reaction vessel equipped with heating and agitating means, a fractional distillation column and means for maintaining a nitrogen blanket over a reaction mixture, there are added the hexahydrophthalic anhydride and neopentyl glycol, which are mixed and heated to 66° C. Thereafter the trimethylolpropane is added and the mixture is heated to 66° C. The adipic acid is then charged to the reaction mixture, which is heated to 182° C. and held for one-half hour while water is distilled off. The mixture is thereafter heated to 215° C. A sample taken after 7½ hours is identified as a saturated polyester polyol having an acid number of 14.9 and a hydroxyl number of 143. The reaction vessel is now set for azeotropic reflux. The toluene is added carefully to cool the mixture to 150° C., after which time the diethanolamine is added. The mixture is maintained as an azeotropic boiling mixture at 146° C. until an acid value of less than 5 is obtained. The n-butyl acetate is added to obtain a fluid mixture.

To 28 parts of the polyester polyol is added to 10.4 parts of "Micro 750" graphite (Asbury Graphite Mills, Inc., Asbury, N.J.) and 181.7 parts of a solvent consisting of a mixture of urethane grade butyl acetate, Cellosolve acetate and methylethylketone, in a ratio of 36 to 56 to 8.

The second package of the two-package system is prepared by mixing 268 parts of an NCO-containing component, commercially identified as Spenlite P25-60CX (an NCO-terminated adduct of trimethylolpropane/neopentyl glycol/isophorone diisocyanate dissolved in a xylene/Cellosolve acetate solvent mixture; available from Spencer-Kellogg Co.) with 32.4 parts of the solvent mixture mixed with the polyester polyol of the first package.

A sprayable mixture having a sprayable pot life of about 8 hours is prepared by mixing together the contents of the first package with 42 parts of the second package. The mixture is spray applied to an electrode substrate fabricated of an electrically non-conductive or dielectric material to form a cured film on the substrate of about one-to-two mils in thickness. Alternatively, the coating can be formed of a semi-conductive plastic material such as Valox ®(General Electric Company) doped with graphite.

During operation, the induction charging eletrode 40 imparts a charge on initially grounded liquid particles substantially simultaneously with particle formation as said particles issue from the nozzle assembly 34. For example, the induction charging electrode can be positively charged to thereby induce a negative charge on the particles, with preferred voltage at the induction charging electrode 40 being about 4 to 12 KV for water borne paint and to about 25 KV for organic solvent-reduced paint. The repelling electrode 42 has a polarity opposite that of the induction charging electrode 40. Thus, when the induction charging electrode 40 has a positive charge as above described, the repelling electrode 42 has a negative charge which is, of course, of the same polarity as the charged particles. Preferred voltage at the repelling electrode 42 is about 10 to 25 KV. In such manner the charged particles, issuing as a stream through the housing 14, are repelled by the same-polarity repelling electrode 42 and are thus inhibited from drifting from the spray stream. As a result, a better-defined spray stream issues for deposition on a workpiece. Because the uncoated portion of the screen 38 is electrically non-conductive or dielectric, the induction charging electrode 40 and the repelling electrode 42 are substantially electrically isolated from each other. Concurrently, during operation, gas enters the housing 14 via the gas inlet tube 16, and exits from the housing 14 through the screen 38 as an envelope concentrically surrounding the exiting spray stream. Because the gas can be pre-conditioned as to composition, type, temperature, moisture content, and the like before entry into the housing 14, ambient conditions become substantially irrelevant in regard to their effects upon coating deposition on a workpiece. Thus, for example, a high-humidity ambient condition which can inhibit proper drying of a water-base paint composition can be overcome by merely utilizing a heated low-humidity gas for issue from the housing 14. Use of a heated low-humidity gas passing through the screen 38 acts to inhibit deposition of charged sprayed liquid particles on the spraying apparatus, and further acts to electrically isolate the induction charging electrode 40 and repelling electrode 42 from each other by preventing current leakage across the uncoated portion of the screen 38.

The housing 14 is removably secured to the nozzle extender 12 and thus to the spray gun 10 through a back plate 48 through the center of which said nozzle extender 12 tightly passes. The back plate 48 tightly engages the side wall of the housing 14 and is removable therefrom.

Figure 5:
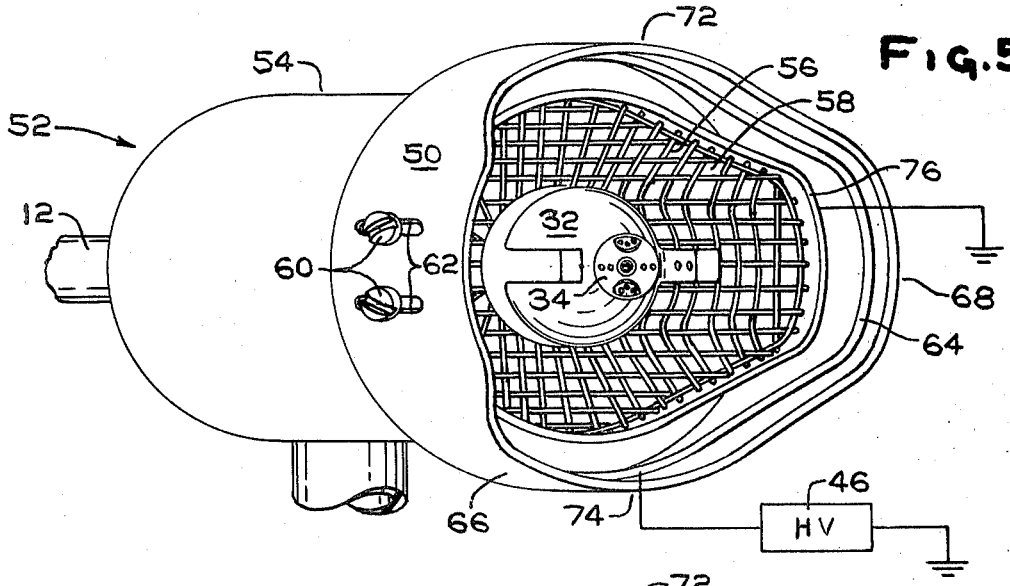
FIG. 5 is a perspective view of a repelling electrode adapter mounted to a spraying apparatus having induction charging electrode means.
Figure 6:
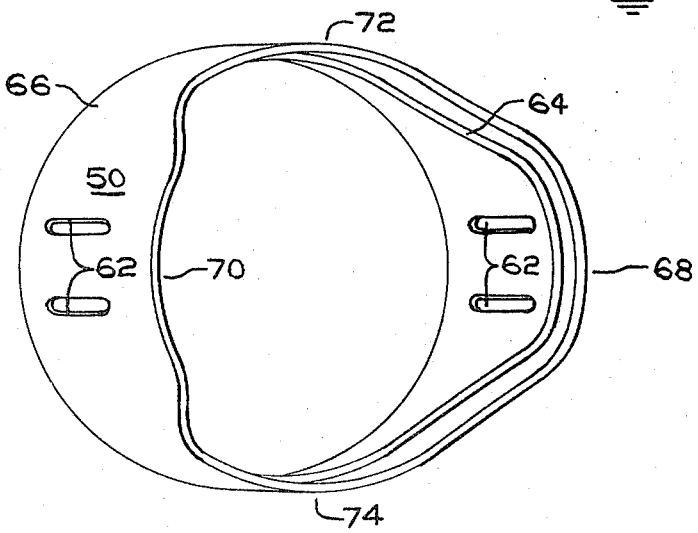
FIG. 6 is a perspective view of the repelling electrode adapter of FIG. 5.

Referring to FIGS. 5 and 6, FIG. 5 shows a repelling electrode adapter 50 mounted to an electrostatic spraying apparatus 52 comprising a gas shroud housing 54 having an induction charging electrode 56 coated on a screen 58 therein; and an air cap 32 and nozzle assembly 34 on the end of a nozzle extender 12 attached to a conventional air-operated spray gun (not shown). The electrostatic spraying apparatus 52 is essentially the same as that illustrated in FIGS. 1–3 with two exceptions, one exception being that said apparatus 52 has no repelling electrode secured along the inner surface of the wall of the housing 54. Instead, a repelling electrode adapter 50 is mounted to the apparatus 52 by means of respective screws 60 passing through slots 62 on each side of the adapter 50 to be threadably secured into correspondingly bored circular openings in the housing 54 of said apparatus 52. The second exception involves the induction charging electrode 56, wherein said electrode 56 is coated on substantially all of the screen 58 rather than only in relatively close proximity to the nozzle assembly 34. It is to be understood, however, that any effective induction charging electrode means can be employed. Utilization of slots 62 permits flexible positioning of the adapter 50. The housing 66 of the electrode adapter 50 is electrically non-conductive or dielectric. In the embodiment illustrated, said housing 66 is fiberglass impregnated with epoxy resin. The outside diameter of the housing 54 is $3\frac{3}{4}$ inches (9.5 cm), and of the adapter 50 is $5\frac{1}{4}$ inches (13.3 cm).

Within the housing of the repelling electrode adapter 50 is a repelling electrode 64 to which a repelling-electrode voltage source 46, shown diagrammatically, provides energy. The repelling electrode 64 is disposed aft of the perimeter of the housing 66 to improve operator safety by reducing the possibility of operator contact with said electrode 64. In the embodiment here illustrated the repelling electrode 64 is a polyurethane resin-graphite matrix film coating as earlier described. The housing 66 of the adapter 50 is formed to provide two diametrically opposed lobes 68,70 and two diametrically opposed recessed 72,74. Positioning of the recesses 72,74 corresponds directly to a fan-shape spray of liquid particles issuing from the spraying apparatus. During operation of the spraying apparatus 52, the repelling electrode 64 is charged to a polarity opposite the polarity of the induction charging electrode 56 to thereby be of the same polarity as that of the inductively charged liquid particles. In such manner the repelling electrode 64 acts to maintain a better defined spray stream by providing a repulsion zone and thereby repelling the issuing charged liquid particles to thus force them to maintain closer proximity to the workpiece to encourage particle deposition thereon at higher efficiencies.

For example, the induction charging electrode 56 can be supplied with about 4 to 12 KV positive for water borne paint and to about 25 KV positive for organic solvent-reduced paint, while the repelling electrode 64 is supplied with about 10 to 25 KV negative. The induction charging electrode 56 and the repelling electrode 64 are substantially electrically isolated from each other in normal operation, with said isolation being optionally further assured by means of a grounded electrode 76, of the same material as the repelling electrode 64, disposed on the perimeter of the gas shroud housing 54. The voltage of the repelling electrode can be greater than that preferred above, but care must be taken to not reach a voltage value where an intense electrical field from the repelling electrode interferes with the electrical field from the induction charging electrode to result in reduced particle charging. Physical distance of the repelling electrode from the induction charging electrode further determines maximum effective voltage, with increase in distance being directly related to increase in maximum permissible voltage.

While the preferred embodiment illustrates an induction charging eletrostatic spraying apparatus which includes a gas shroud housing, it is to be understood that such apparatus need not employ a gas shroud housing to benefit from the repelling electrode adapter herein described. Indeed, any induction charging electrostatic spraying apparatus can benefit from the inclusion of a repelling electrode adapter for provision of a resulting repulsion zone wherein inductively charged liquid particles are axially confined prior to travel to a workpiece to be coated.

What is claimed is:

1. Electrostatic spraying apparatus comprising:

(a) an electrically non-conductive or dielectric housing having an opening with a perimeter;

(b) liquid atomization means mounted in said housing, said liquid atomization means being capable of dispersing a liquid into a spray of liquid particles directed outwardly through said opening of said housing;

(c) a screen extending essentially radially outwardly from said liquid atomization means and disposed substantially entirely between said liquid atomization means and said perimeter of said opening, said screen adjacent said liquid atomization means providing induction charging electrode means and the remainder of said screen being dielectric or electrically non-conductive, said induction charging electrode means being chargeable to a first polarity and being in cooperative spatial relationship with said liquid atomization means to impart an electrical charge on said liquid particles substantially simultaneously with the formation of said liquid particles to produce an electrically charged spray of liquid particles, said imparted electrical charge being of a second polarity which is opposite the polarity of said induction charging electrode means;

(d) gas inlet means to said housing for delivering a flow of gas to said housing whereby said gas exits through said opening of said housing and substantially concentrically envelops said electrically charged spray of liquid particles; and (e) repelling electrode means mounted within said housing and spaced inwardly from said perimeter of said opening, said repelling electrode means being substantially electrically isolated from said induction charging electrode means and being chargeable to a polarity opposite the polarity of said induction charging electrode means and of the same polarity as said electrically charged spray of liquid particles to repel said electrically charged spray of liquid particles immediately prior to the exiting of said electrically charged spray of liquid from said opening.

2. Electrostatic spraying apparatus as claimed in claim 1 wherein said induction charging electrode means comprises a semi-conductive film coating.

3. Electrostatic spraying apparatus as claimed in claim 2 wherein said screen is constructed of nylon.

4. Electrostatic spraying apparatus as claimed in claim 2 wherein said induction charging electrode means is a film coating of a polyurethane resin-graphite matrix.

5. Electrostatic spraying apparatus as claimed in claim 1 wherein said gas exits through said screen between said induction charging electrode means and said repelling electrode means.

6. Electrostatic spraying apparatus as claimed in claim 1 wherein said repelling electrode means is a film coating of a polyurethane resin-graphite matrix.

7. Electrostatic spraying apparatus as claimed in claim 1 wherein said housing is constructed of fiberglass impregnated with epoxy resin.

8. Electrostatic spraying apparatus as claimed in claim 1 wherein said liquid atomization means is an air-atomization spray gun.

9. Electrostatic spraying apparatus as claimed in claim 1 wherein said gas inlet means is a tubular opening extending from said housing.

10. Electrostatic induction charging gas shroud adapter comprising:

(a) an electrically non-conductive or dielectric housing to which can be mounted liquid atomization means, said housing having an opening with a perimeter, said liquid atomization means when mounted being capable of dispersing a liquid into a spray of liquid particles directed outwardly through said opening of said housing;

(b) a screen extending essentially radially outwardly from said liquid atomization means when mounted and disposed substantially entirely between said liquid atomization means when mounted and said perimeter of said opening, said screen adjacent said liquid atomization means when mounted providing induction charging electrode means and the remainder of said screen being dielectric or electrically non-conductive, said induction charging electrode means being chargeable to a first polarity and being in cooperative spatial relationship with said liquid atomization means when mounted to impart an electrical charge on said liquid particles substantially simultaneously with the formation of said liquid particles to produce an electrically charged spray of liquid particles, said imparted electrical charge being of a second polarity which is opposite the polarity of said induction charging electrode means;

(c) gas inlet means to said housing for delivering a flow of gas to said housing whereby said gas exits through said opening of said housing and substantially concentrically envelops said electrically charged spray of liquid particles; and (d) repelling electrode means mounted within said housing and spaced inwardly from said perimeter of said opening, said repelling electrode means being substantially electrically isolated from said induction charging electrode means and being charageable to a polarity opposite the polarity of said induction charging electrode means and of the same polarity as said electrically charged spray of liquid particles to repel said electrically charged spray of liquid particles immediately prior to the exiting of said electrically charged spray of liquid particles from said opening.

11. Electrostatic induction charging adapter as claimed in claim 10 wherein said induction charging electrode means comprises a semiconductive film coating.

12. Electrostatic induction charging adapter as claimed in claim 11 wherein said screen is constructed of nylon.

13. Electrostatic induction charging adapter as claimed in claim 11 wherein said induction charging electrode means is a film coating of a polyurethane resin-graphite matrix.

14. Electrostatic induction charging adapter as claimed in claim 10 wherein said gas exits through said screen between said induction charging electrode means and said repelling electrode means.

15. Electrostatic induction charging adapter as claimed in claim 10 wherein said repelling electrode means is a film coating of a polyurethane resin-graphite matrix.

16. Electrostatic induction charging adapter as claimed in claim 10 wherein said housing is constructed of fiberglass impregnated with epoxy resin.

17. Electrostatic induction charging adapter as claimed in claim 10 wherein said gas inlet means is a tubular opening extending from said housing.

18. Repelling electrode adapter for induction charging electrostatic spraying apparatus having induction charging electrode means chargeable to a first polarity, said adapter comprising:

(a) an electrically non-conductive or dielectric housing mountable to an induction charging electrostatic liquid atomization means, said housing having an opening with a perimeter; and (b) semi-conductive repelling electrode means disposed in said housing and spaced inwardly from said perimeter of said opening, said semi-conductive repelling electrode means being substantially electrically isolated from said induction charging electrode means when mounted and being chargeable to a polarity opposite the polarity of said induction charging electrode means to define when mounted an electrical repulsion zone for repelling an inductively charged spray of liquid particles issuing from said induction charging electrostatic spraying apparatus.

19. Repelling electrode adapter as claimed in claim 18 wherein said electrode means is a film coating of a polyurethane resin-graphite matrix.

20. Repelling electrode adapter as claimed in claim 18 wherein said housing is constructed of fiberglass impregnated with epoxy resin.

* * * * *

UNITED STATES PATENT AND TRADEMARK OFFICE

CERTIFICATE OF CORRECTION

PATENT NO. : 4,240,585

DATED : December 23, 1980

INVENTOR(S) : James E. Sickles

It is certified that error appears in the above-identified patent and that said Letters Patent are hereby corrected as shown below:

Column 8, line 56, "spray of liquid from said opening" should be

--spray of liquid particles from said opening--.

Signed and Sealed this

*Twenty-eighth* Day of *April 1981*

[SEAL]

*Attest:*

RENE D. TEGTMEYER

*Attesting Officer* *Acting Commissioner of Patents and Trademarks*